US011598248B2

(12) United States Patent
Andersson

(10) Patent No.: US 11,598,248 B2
(45) Date of Patent: Mar. 7, 2023

(54) INTERNAL COMBUSTION ENGINE SYSTEM

(71) Applicant: VOLVO TRUCK CORPORATION, Gothenburg (SE)

(72) Inventor: Arne Andersson, Mölnlycke (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 17/453,963

(22) Filed: Nov. 8, 2021

(65) Prior Publication Data

US 2022/0154652 A1 May 19, 2022

(30) Foreign Application Priority Data

Nov. 17, 2020 (EP) ..... 20208001

(51) Int. Cl.

| | |
|---|---|
| ***F02D 15/04*** | (2006.01) |
| ***F01B 31/14*** | (2006.01) |
| ***F02B 33/06*** | (2006.01) |
| ***F02B 33/18*** | (2006.01) |
| ***F02B 33/20*** | (2006.01) |
| ***F02B 33/22*** | (2006.01) |
| *F02B 75/28* | (2006.01) |

(52) U.S. Cl.

CPC ..... *F02B 33/20* (2013.01); *F01B 31/14* (2013.01); *F02B 33/06* (2013.01); *F02B 33/18* (2013.01); *F02B 33/22* (2013.01); *F02D 15/04* (2013.01); *F02B 75/28* (2013.01); *F02B 75/282* (2013.01)

(58) Field of Classification Search

None

See application file for complete search history.

(56) References Cited

U.S. PATENT DOCUMENTS

| | | | | |
|---|---|---|---|---|
| 2,970,581 A * | 2/1961 | Georges | F02D 15/04 | 123/286 |
| 3,808,818 A * | 5/1974 | Cataldo | F02B 75/02 | 123/1 R |
| 4,157,080 A * | 6/1979 | Hill | F02B 41/06 | 123/58.8 |
| 4,202,300 A * | 5/1980 | Skay | F02D 15/04 | 123/58.8 |
| 6,789,514 B2 * | 9/2004 | Suh | F02B 75/20 | 123/70 R |

(Continued)

FOREIGN PATENT DOCUMENTS

| | | | |
|---|---|---|---|
| AU | 2008284383 A1 * | 11/2009 | F01L 1/465 |
| AU | 2008284439 A1 * | 11/2009 | F01L 1/465 |

(Continued)

OTHER PUBLICATIONS

European Search Report dated May 21, 2021 in corresponding European Patent Application No. 20208001.6, 7 pages.

*Primary Examiner* — Kevin R Steckbauer

(74) *Attorney, Agent, or Firm* — Venable LLP; Jeffri A. Kaminski

(57) ABSTRACT

An internal combustion engine system includes a reciprocating compressor for pressurizing a fluid medium and having a compressor cylinder for accommodating a compressor piston. The compressor cylinder has a main cylinder volume and a secondary adjustable volume in fluid communication with the main cylinder volume so as to provide a variable geometrical compression ratio.

15 Claims, 6 Drawing Sheets

(56) References Cited

U.S. PATENT DOCUMENTS

| | | | | | |
|---|---|---|---|---|---|
| 8,807,099 | B2 * | 8/2014 | Branyon | F02B 67/10 | 123/70 R |
| 9,458,741 | B2 * | 10/2016 | Mistry | F01L 1/344 | |
| 10,480,457 | B2 * | 11/2019 | Liu | F02M 25/03 | |
| 10,774,734 | B2 * | 9/2020 | Andersson | F02B 75/227 | |
| 11,118,503 | B2 * | 9/2021 | Andersson | F02B 41/06 | |
| 2003/0019444 | A1 * | 1/2003 | Suh | F02B 75/20 | 123/70 R |
| 2006/0180105 | A1 * | 8/2006 | Springer | F02B 33/22 | 123/70 V |
| 2006/0243229 | A1 * | 11/2006 | Zajac | F02G 1/02 | 123/70 R |
| 2006/0254249 | A1 * | 11/2006 | Zajac | F01L 7/027 | 60/39.6 |
| 2009/0272357 | A1 * | 11/2009 | Yaoita | F02D 15/04 | 123/188.4 |
| 2010/0300385 | A1 * | 12/2010 | Durrett | F02B 41/06 | 123/64 |
| 2012/0073551 | A1 * | 3/2012 | Branyon | F02B 67/10 | 123/70 R |
| 2014/0090615 | A1 * | 4/2014 | Mistry | F02D 15/04 | 123/90.17 |
| 2014/0130770 | A1 * | 5/2014 | Liu | F02M 25/03 | 123/25 A |
| 2015/0090224 | A1 * | 4/2015 | Clarke | F02B 41/08 | 123/445 |
| 2015/0252718 | A1 * | 9/2015 | Kristani | F02B 33/06 | 123/542 |
| 2019/0178152 | A1 * | 6/2019 | Andersson | F02D 41/024 | |
| 2020/0173329 | A1 * | 6/2020 | Andersson | F02B 33/20 | |
| 2020/0386151 | A1 * | 12/2020 | Andersson | F02B 33/22 | |
| 2021/0108559 | A1 * | 4/2021 | Andersson | F02B 41/06 | |

FOREIGN PATENT DOCUMENTS

| | | | | |
|---|---|---|---|---|
| AU | 2008284441 | A1 * | 11/2009 | F01L 1/465 |
| AU | 2008284442 | A1 * | 11/2009 | F01L 1/465 |
| AU | 2008284442 | B2 * | 4/2011 | F01L 1/465 |
| AU | 2008284383 | B2 * | 9/2011 | F01L 1/465 |
| AU | 2008284439 | B2 * | 10/2011 | F01L 1/465 |
| CA | 2531520 | C * | 4/2009 | F02B 33/22 |
| CA | 2802522 | A1 * | 3/2012 | F02B 33/22 |
| CN | 102434271 | A * | 5/2012 | F02B 33/22 |
| CN | 103620181 | A * | 3/2014 | F01L 1/344 |
| CN | 106304839 | A * | 1/2017 | F02B 29/04 |
| CN | 103620181 | B * | 6/2017 | F01L 1/344 |
| CN | 108368771 | A * | 8/2018 | F01B 1/06 |
| CN | 109519273 | A * | 3/2019 | |
| CN | 109790778 | A * | 5/2019 | F01N 3/0253 |
| CN | 110939506 | A * | 3/2020 | |
| CN | 109790778 | B * | 7/2021 | F01N 3/0253 |
| DE | 10228303 | A1 * | 3/2003 | F02B 75/042 |
| EP | 2699777 | A1 * | 2/2014 | F01L 1/344 |
| EP | 2699777 | B1 * | 1/2017 | F01L 1/344 |
| FI | 124351 | B | 7/2014 | |
| FR | 2593231 | A1 * | 7/1987 | F02B 33/20 |
| GB | 2520502 | A * | 5/2015 | F01L 1/38 |
| JP | 2003293805 | A | 10/2003 | |
| JP | 2003293805 | A * | 10/2003 | |
| JP | 2004011501 | A * | 1/2004 | |
| JP | 2007177770 | A | 7/2007 | |
| JP | 2007177770 | A * | 7/2007 | |
| JP | 6093346 | B2 * | 3/2017 | F01L 1/344 |
| RU | 2744262 | C1 * | 3/2021 | |
| TW | 200918730 | A * | 5/2009 | F01L 1/465 |
| WO | WO-03046347 | A1 * | 6/2003 | F02B 33/22 |
| WO | WO-2006096850 | A2 * | 9/2006 | F01B 31/14 |
| WO | WO-2006099064 | A2 * | 9/2006 | F01B 31/14 |
| WO | WO-2006099066 | A2 * | 9/2006 | F01B 31/14 |
| WO | WO-2009083182 | A2 * | 7/2009 | F02B 21/00 |
| WO | 2009155620 | A1 | 12/2009 | |
| WO | WO-2009155620 | A1 * | 12/2009 | F02B 41/08 |
| WO | WO-2012062291 | A2 * | 5/2012 | F02B 33/22 |
| WO | WO-2012062291 | A3 * | 9/2012 | F02B 33/22 |
| WO | WO-2012143940 | A1 * | 10/2012 | F01L 1/344 |
| WO | WO-2015090340 | A1 * | 6/2015 | F02B 33/22 |
| WO | WO-2015144188 | A1 * | 10/2015 | F02B 33/02 |
| WO | WO-2017101965 | A1 * | 6/2017 | F01B 1/06 |
| WO | WO-2017102813 | A2 * | 6/2017 | F01B 1/06 |
| WO | WO-2018054490 | A1 * | 3/2018 | F01N 3/0253 |
| WO | 2018166591 | A1 | 9/2018 | |
| WO | WO-2018166591 | A1 * | 9/2018 | F02B 41/00 |

* cited by examiner

INTERNAL COMBUSTION ENGINE SYSTEM

TECHNICAL FIELD

The present disclosure relates to an internal combustion engine system comprising a reciprocating compressor for pressurizing a fluid medium. The disclosure is applicable on vehicles, in particularly heavy vehicles, such as e.g. trucks. However, although the present disclosure will mainly be described in relation to a truck, the internal combustion engine system may also be applicable for other types of vehicles propelled by means of an internal combustion engine. In particular, the present disclosure can be applied in heavy-duty vehicles, such as trucks, buses and construction equipment, but also in cars and other light-weight vehicles etc. Further, the internal combustion engine is typically a hydrogen internal combustion engine.

BACKGROUND

For many years, the demands on internal combustion engines have been steadily increasing and engines are continuously developed to meet the various demands from the market. By way of example, reduction of exhaust gases, increasing engine efficiency, i.e. reduced fuel consumption, and lower noise level from the engines are some of the criteria that have become more important aspects when designing and selecting a suitable internal combustion engine (ICE) system and its engine component. Furthermore, in the field of heavy-duty vehicles, such as trucks, there are a number of prevailing environmental regulations that set specific requirements on the vehicles, e.g. restrictions relating to maximum allowable amount of exhaust gas pollution.

In order to meet at least some of the above-mentioned demands, various engine concepts have been developed throughout the years where conventional combustion cylinders have been combined with e.g. a pre-compression stage and/or an expansion stage.

One type of ICE system that has the potential to meet prevailing and future environmental regulations is a hydrogen ICE system in which the combustion of hydrogen with oxygen produces water as its only product. In such hydrogen ICE system, there is generally a compressor for pressurizing the air before entering the combustion cylinder so as to provide an appropriate mixture of hydrogen and air in the combustion cylinder when performing and completing the combustion reaction. However, compressors may frequently also be used in other types of ICE systems, such as more conventional diesel-type ICE systems.

It would be desirable to further improve the operation of the compressor in an ICE system.

SUMMARY

An object of the invention is to provide an improved operation of a compressor for an internal combustion engine system, in which the compressor can be operable more efficiently in relation to changes in engine loads of the ICE system.

According to a first aspect of the disclosure, there is provided an internal combustion engine (ICE) system comprising a reciprocating compressor for pressurizing a fluid medium. The reciprocating compressor comprises a compressor cylinder for accommodating a compressor piston. In addition, the compressor cylinder has a main cylinder volume and a secondary adjustable volume in fluid communication with the main cylinder volume so as to provide a variable geometrical compression ratio.

By providing a compressor with a secondary adjustable volume, it becomes possible to adjust the geometrical compression ratio in response to the demands from the ICE system. In addition, by providing a compressor with a variable geometrical compression ratio, it becomes possible to downrate the size of the compressor in the ICE system, at least to some extent. To this end, the present disclosure may not only have a positive impact on the possibility of reducing the size of the ICE system due to a more efficient compressor operation, but also on the overall manufacturing costs for the ICE system.

While the present disclosure may be used in any type of ICE system that includes a piston compressor for compressing a fluid medium, the present disclosure is particularly useful for a hydrogen internal combustion system. Hence, according to at least one embodiment, the ICE system is a hydrogen ICE system. In such hydrogen ICE system, the combustion of hydrogen with oxygen produces water as its only product. In addition, hydrogen can be combusted in an internal combustion engine over a wide range of fuel-air mixtures. While a hydrogen ICE system may be operated to produce very low emissions during certain conditions, the amount of NOx emission may at least partly depend on the air/fuel ration, the engine geometrical compression ratio as well as the engine speed and the ignition timing. In addition, combustion of air/fuel in a hydrogen ICE system may pose higher demands on the strength and size of the engine components compared to e.g. a traditional gasoline engine.

Typically, the reciprocating compressor is configured to compress air by a displacement of the compressor piston from a bottom dead centre (BDC) to top dead centre (TDC). Moreover, the main cylinder volume generally defines a first space for compressing air. Analogously, the secondary adjustable volume may be considered to define an additional space for compressing air. As such, the secondary adjustable volume provides for adjusting the total volume (i.e. an interior space defined by the first space and the additional space) of the reciprocating compressor. In this manner, it becomes possible to provide a variable compressor ratio during operation of the reciprocating compressor and the ICE system.

By providing a variable geometrical compression ratio control, the invention allows for adjusting the dead volume of the compressor, i.e. the relationship between an inner volume of the compressor when the piston is at TDC and an inner volume of the compressor when the piston is at the BDC.

In general, the secondary adjustable volume provides for an increased "dead volume" for the compressor. The dead volume may generally amount to the volume of the compressor when the piston is at the TDC. In other words, the dead volume may be the volume as defined by the total volume of the compressor minus the swept volume. The dead volume may also be denoted as the clearance volume or the bumping clearance. The configuration of the compressor can be provided in several different ways. Typically, the secondary adjustable volume is provided by a compartment arrangement. The compartment may comprise a number of sub-compartments defining a number of sub-volumes. In this manner, the secondary adjustable volume is adjustable by means of the number of sub-compartments, i.e. the sub-compartments provide for different dead volumes.

In addition, or alternatively, the secondary adjustable volume is provided by a compartment configured to be adjustable in size. Analogously, in an example where the secondary adjustable volume is defined by a number of sub-compartments, each one of the sub-compartments may also be adjustable in size, i.e. adjustable in volume.

According to at least one embodiment, the secondary adjustable volume is configured to provide for a geometrical compression ratio control of the compressor cylinder by adjusting the volume of the secondary adjustable volume into a number of defined volumes. Typically, the secondary adjustable volume comprises at least a plurality of volume compartment portions.

According to at least one embodiment, the secondary adjustable volume comprises at least a plurality of volume compartment portions of different size. In this manner, it becomes possible to provide a more step-less control of the adjustable volume. In addition, using volume portions of different sizes increases the number of possible volume combinations of the adjustable volume.

According to at least one embodiment, the secondary adjustable volume comprises at least a plurality of volume compartment portions of fixed size. By having a plurality of volume portions of fixed size, there is provided a more simple arrangement of the adjustable volume.

According to at least one embodiment, the total dead volume is provided by at least two volumes compartment portions of equivalent size.

According to at least one embodiment, the total dead volume is provided by at least two volume compartment portions of different size.

By way of example, each one of the two volume compartment portions of different size are individually arranged in fluid communication with the main cylinder volume by at least one valve. By connecting the two volume compartment portions to the main volume of the compressor cylinder by the valve, it becomes possible to provide four different geometrical compression ratios. That is, the different geometrical compression ratios can be obtainable by controlling the openness of the valve. In this manner, there is provided a secondary adjustable volume having four different dead volume controls (i.e. providing four different geometrical compression ratios).

The at least one valve may be a rotatable valve assembly arranged to open and close an entrance to the at least two volume compartment portions of different size, respectively, by a rotation of the rotatable valve around its centre axis. The two compartments can be set in fluid communication with the main cylinder volume of the compressor by controlling the valve.

In another example embodiment, each one of the two volume compartment portions are individually arranged in fluid communication with the main cylinder volume by first and second valves, respectively.

In addition, the valves may be different for different compressor configurations. By way of example, the type of valve can be selected from the group of poppet valves, rotary valves, reed valves, slide valves or any other suitable valve.

In an example where the valve is a slide valve, the slide vale is arranged in-between the main cylinder volume and the secondary adjustable volume, wherein the slide valve is arranged to press against the opening of the secondary adjustable volume by means of the compression pressure in the compressor cylinder. In this example, a displacement of the slide valve is effected from a closed position to an open position when the pressure is at atmospheric pressure in the compressor cylinder during the compressor intake stroke. In this manner, it becomes possible to reduce losses and wear. Moreover, it becomes possible to provide an ICE system with at least one valve that allows for a less powerful valve actuator compared to more sophisticated valves.

Typically, the fluid medium to be compressed by the compressor is air (oxygen). The reciprocating compressor may thus generally comprise an inlet for ambient air and an outlet for the compressed air. The inlet may comprise an inlet valve for regulating the inflow of air into the compressor and the outlet may comprise an outlet valve for regulating the outflow of compressed air from the compressor, which are commonly known in the art. The inlet and outlet are generally closed during compression of the air.

Typically, the reciprocating compressor is operable by a crankshaft of an internal combustion engine.

Typically, the compressor cylinder is configured to compress a volume of air and transfer the compressed air to at least one combustion piston of the ICE system. In this type of configuration of the present disclosure, the (dead) volume of the secondary adjustable volume is thus adjusted so as to regulate the geometrical compression ratio of the compressor in order to obtain the desired air flow into the combustion cylinder of the ICE system.

According to at least one embodiment, the volume of the secondary adjustable volume is adjusted in response to the engine load of the ICE system. By adjusting the volume of the secondary adjustable volume in response to the engine load of the ICE system, it becomes possible to operate the compressor in a more efficient manner by adjusting the geometrical compression ratio based on the load on the ICE. To this end, it becomes possible to regulate the flow of fresh air and exhaust gas recirculation (EGR) that is pumped through the ICE system. Generally, each engine load/rpm point may have a target value for the fresh air and EGR flow.

In particular, by regulating the dead volume (via the secondary adjustable volume) in response to the load on the engine, it becomes not only possible to provide a more efficient compressor in that the dead volume can be adjusted in response to the engine load, but also to reduce pumping losses and friction at low loads. That is, the present disclosure allows for operating the compressor with a lower geometrical compression ratio at low loads. In this manner, it becomes possible to down rate the compressor The engine load of the ICE system can be determined in several different manners. The engine load is typically determined by a control unit, such as an ECU of the ICE system or the vehicle. By way of example, the engine load of the ICE system may be determined based on an actuation of a vehicle acceleration device, such as an acceleration pedal. The requested propulsion torque may e.g. be determined based on the position of the acceleration pedal, as manipulated by a driver. In addition, or alternatively, the engine load of the ICE system may be determined based on data indicative of a requested propulsion torque by means of a control unit, such as an electronic control unit. The term "requested propulsion torque", as used herein, typically refers to propulsion torque needed for the vehicle at the present state, i.e. the torque deliverable by the internal combustion engine upon a request from a driver, control unit etc. Typically, a certain torque request results in a certain setting of actuators in the ICE. In addition, ICE system may comprise one or more sensors for gathering relevant data, e.g. a pressure sensor in the expander, or at least a pressor sensor in cold tank between the compressor and the combustion cylinder so as to more accurately determine the effect of the certain torque request. The relevant data gather from the ICE system may be transferred to the control unit of the ICE system or the vehicle. Hence, the pressure sensor(s) may typically be arranged in communication with the control unit of the ICE system or the vehicle.

According to at least one embodiment, the ICE system is operable to adjust the secondary adjustable volume by opening/closing a passage between the main volume and the secondary adjustable volume. Typically, the ICE system is operable to adjust the secondary adjustable volume by opening/closing the passage between the main cylinder volume and the secondary adjustable volume when the pressure in the main cylinder volume is essentially similar to the pressure in the secondary adjustable volume.

According to at least one embodiment, the ICE system is operable to detect the position of the compressor piston in the compressor cylinder. Typically, the position of the compressor piston may be determined by a flywheel position sensor, as is commonly used in the field of ICE systems. To this end, the volume of the secondary adjustable volume may typically be adjusted in response to the detected position of the compressor piston in the compressor cylinder so as to adjust the volume of the secondary adjustable volume based on the engine load. The flywheel position sensor may be arranged in communication with a control unit of the ICE system and/or the vehicle.

According to at least one embodiment, the ICE system is operable such that the fluid communication between the main cylinder and the secondary adjustable volume is always open during a compression stroke. In particular, the fluid communication between the main cylinder and the secondary adjustable volume is open during the compression stroke and until there is a change in engine load in the ICE system. In this manner, there is always a certain dead volume opened during the compression stroke until there is a lower or larger demand for air due to a change in the engine load.

According to at least one embodiment, the ICE system comprises the control unit for controlling the secondary adjustable volume.

The control unit may include a microprocessor, microcontroller, programmable digital signal processor or another programmable device. Thus, the control unit typically comprises electronic circuits and connections as well as processing circuitry such that the control unit can communicate with different parts of the ICE system such as the ICE, the compressor, the expander or any other component of the vehicle, such as the clutch, and/or any other parts in need of being operated in order to provide the functions of the example embodiments. Typically, the control unit may also be configured to communicate with other parts of the vehicle such as the brakes, suspension, and further electrical auxiliary devices, e.g. the air conditioning system, in order to at least partly operate the vehicle. The control unit may comprise modules in either hardware or software, or partially in hardware or software and communicate using known transmission buses such as CAN-bus and/or wireless communication capabilities. The processing circuitry may be a general purpose processor or a specific processor. The control unit typically comprises a non-transitory memory for storing computer program code and data upon. Thus, the control unit may be embodied by many different constructions.

In other words, the control functionality of the example embodiments of the ICE system may be implemented using existing computer processors, or by a special purpose computer processor for an appropriate system, incorporated for this or another purpose, or by a hardwire system. Embodiments within the scope of the present disclosure include program products comprising machine-readable medium for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions. While the example embodiments of the system described above includes a control unit being an integral part thereof, it is also possible that the control unit may be a separate part of the vehicle, and/or arranged remote from the system and in communication with the system.

While the present disclosure may be used in any type of ICE system comprising a reciprocating compressor, the present disclosure is particularly suitable for an ICE system comprising an expander and a combustion cylinder. Accordingly, the ICE system may typically comprise at least one combustion cylinder configured for combustion of a gaseous fuel within a combustion chamber of the combustion cylinder assembly such as to drive a crankshaft.

Hence, according to at least one embodiment, the ICE system further comprises at least one combustion cylinder housing a combustion piston. The combustion cylinder is configured to be energized by forces of combustion. Moreover, the compressor cylinder is configured to compress a volume of air and transfer the compressed air to the at least one combustion piston. Also, the ICE system comprises an expander cylinder housing an expander piston. The expander cylinder is configured to receive exhaust gases from the at least one combustion piston. In addition, the ICE system comprises a crankshaft that may be connected to the at least one combustion piston and at least one of the expander piston and the compressor piston by a respective connecting rod.

By way of example, the crankshaft is driven by the at least one combustion piston by means of a combustion piston connecting rod and also driven by the expander piston by means of an expander piston connecting rod, while the compressor piston is driven by the crankshaft by means of the expander piston. That is, the crankshaft is connected to the at least one combustion piston and the expander piston by a respective connecting rod. In other words, the expander piston connecting rod transfers the reciprocating motion of the compressor piston and the expander piston to a rotational motion of the crankshaft.

Alternatively, the crankshaft is connected to the at least one combustion piston by a connecting rod, and also to the compressor piston by a connecting rod, whereas the expander piston is connected to the crankshaft by a connecting element assembly extending between the compressor piston and the expander piston.

Hence, according to one embodiment, the crankshaft is driven by the at least one combustion piston by means of the combustion piston connecting rod, and is driven by the expander piston by means of the expander piston connecting rod, wherein the compressor piston is driven by the crankshaft by means of the expander piston.

Typically, the crankshaft is driven, i.e. receives power from, the combustion cylinder and combustion piston due to forces of combustion, and from the expander cylinder and expander piston due to forces of expansion. Moreover, the crankshaft drives, i.e. deliver power to, the compressor piston and the compressor cylinder in order to compress the air. Thus, the crankshaft is rotatably driven by power pistons, i.e. at least the at least one combustion piston and the expander piston, by means of connecting rods, and the crankshaft drives power consuming pistons, i.e. at least the compressor piston, by means of the connecting rods already existing and used for the power pistons. In other words, and according to one embodiment, the ICE system comprises connecting rods only directly connected to the power pistons, i.e. the at least one combustion piston and the expander piston.

By way of example, the crankshaft is driven by the at least one combustion piston by means of the combustion piston connecting rod, and is driven by the expander piston by means of the expander piston connecting rod, wherein the compressor piston is driven by the crankshaft by means of the expander piston.

It should be understood that at least one combustion piston is arranged inside the at least one combustion cylinder, and is adapted for reciprocating motion therein. Correspondingly, the compressor piston and the expander piston are arranged inside the compressor cylinder and the expander cylinder, respectively, and are adapted for reciprocating motion therein.

Moreover, a "downward" stroke of the compressor piston is referred to a stroke of the compressor piston in which the air in the compressor cylinder is compressed. Correspondingly, an "upward" stroke of the compressor piston is referred to a stroke of the compressor piston in the opposite direction.

Moreover, the expander piston may generally be rigidly connected to the compressor piston so as to permit that expander piston can move in unison with compressor piston. In such configuration, the downward and upward strokes of the compressor piston coincides with the respective strokes of the expander piston.

According to at least one embodiment, the compressor piston is connected to the crankshaft via the expander piston, such that a rotational motion of the crankshaft is transferred into a reciprocating motion of the compressor piston via the expander piston connecting rod.

Thus, according to at least one embodiment, the expander piston and the compressor piston are arranged with a common connecting rod. That is, the compressor piston is connected to the crankshaft via the expander piston connecting rod.

In other words, the crankshaft is driven by the at least one combustion piston via its connecting rod, i.e. a combustion piston connecting rod, and is driven by the expander piston via its connecting rod, i.e. an expander piston connecting rod.

According to at least one embodiment, the internal combustion engine further comprises a connecting element assembly rigidly connecting the compressor piston and the expander piston such that the compressor piston and the expander piston can move in unison. By means of the connecting element assembly, there is provided a mechanically stiff connection between the expander piston and the compressor piston, thus increasing the mechanically stability of the internal combustion engine. Since the expander piston and the compressor piston are rigidly connected to each other, the total height of the expander piston and the compressor piston can be lower compared to a design in which the expander piston and the compressor piston are not rigidly connected to each other. Moreover, as the expander piston is rigidly connected to the compressor piston by the connecting element assembly and thereby move in unison with compressor piston, the downward and upward strokes of the compressor piston coincides with the respective strokes of the expander piston.

According to one embodiment, the compressor piston, the expander piston and a portion of the crankshaft are arranged along a geometrical axis, and wherein the portion of the crankshaft is arranged along the geometrical axis in between the compressor piston and the expander piston. Hereby, an even more compact design of the internal combustion engine can be achieved. The portion of the crankshaft can be described as being intermediary of the expander piston and the compressor piston. the portion of the crankshaft may e.g. be a segment of the crankshaft along a longitudinal direction of the crankshaft.

According to one embodiment, a reciprocating motion of the expander piston inside of the expander cylinder occurs along an expander axis, and a reciprocating motion of the at least one combustion piston inside the combustion cylinder occurs along a combustion axis. According to one embodiment, the geometrical axis coincides with the expander axis and the compressor axis.

According to one embodiment, the compressor piston, the expander piston and the portion of the crankshaft are arranged in a geometrical plane extending at least along one of the expander axis and the compressor axis, and perpendicular to a longitudinal axis of the crankshaft, wherein the portion of the crankshaft is arranged in the geometrical plane in a direction perpendicular to the longitudinal axis of the crankshaft between the compressor piston and the expander piston.

According to one embodiment, at least a portion of the compressor piston, at least a portion of the expander piston and at least a portion of the connecting element assembly together form a compressor-expander arrangement surrounding the portion of the crankshaft. According to one embodiment, the compressor-expander arrangement encloses, or encompasses, the portion of the crankshaft. Thus, it becomes possible to provide a compact design of the internal combustion engine system can be achieved.

According to one embodiment, the expander cylinder and the compressor cylinder are co-axially arranged. Thus, alignment of the expander cylinder and the compressor cylinder inside the respective cylinder are facilitated. According to one embodiment, the crankshaft is located closer to the compressor cylinder compared to the expander cylinder. According to one embodiment, the combustion piston connecting rod is coupled to the crankshaft (i.e. the large end of the connecting rod) on the same crankshaft side as the expander connecting rod, opposite to the compressor piston. Hereby, the risk of colliding of internal components is reduced. Thus, an even more compact design of the ICE system can be achieved.

According to one embodiment, the expander cylinder and the compressor cylinder are offset compared to each other. That is, the expander axis and the compressor axis are parallel, but not coinciding.

According to one embodiment, the expander cylinder and the at least one combustion cylinder is arranged inside the internal combustion engine in such way that the expander axis is angled in relation to the combustion axis by between 40 degrees and 90 degrees, preferably between 50 degrees and 75 degrees, and more preferably between 55 degrees and 65 degrees, such as e.g. about 60 degrees.

Thus, the internal components, such as e.g. the various pistons and corresponding connecting rods with their reciprocating and/or rotational motions, can be adapted to be kept out of the way from each other as they move internally inside the internal combustion engine. Hereby, the internal combustion engine system may be made more compact. The at least one combustion cylinder may thus be described as protruding laterally from said crankshaft compared to said expander cylinder.

According to one embodiment, the expander piston connecting rod and the combustion piston connecting rod are coupled to the crankshaft by a respective crank pin. Thus, the expander piston and the at least one combustion piston may individually be phased relative each other in relation to the crankshaft. Hereby, an even distribution of torque pulses can be achieved. According to one embodiment, the expander piston connecting rod and the combustion piston connecting rod are coupled to the crankshaft by the same crank pin.

According to one embodiment, the expander piston is physically separated from the compressor piston by the connecting element. That is, the expander piston and the compressor piston are not a common piston, but rather two separate pistons rigidly connected by the connecting element. Thus, the expander piston, the compressor piston and the connecting element may be referred to as a compressor-expander arrangement in which the two pistons are rigidly connected to each other by the connecting element. The expander piston, the compressor piston and the connecting element may according to one embodiment be made in one piece, and/or be comprised in one single unit.

According to one embodiment, the at least one combustion cylinder is a first combustion cylinder and said combustion piston is a first combustion piston, and the internal combustion engine further comprises a second combustion cylinder housing a second combustion piston, the second combustion cylinder being configured to be energized by forces of combustion.

Thus, the at least one combustion cylinder may be referred to as at least two combustion cylinders. The second combustion piston is according to one embodiment connected to said crankshaft via a connecting rod. That is, the first and the second combustion pistons are connected to the same crankshaft.

It should be understood that the at least one combustion cylinder, or the at least two combustion cylinders, is according to one embodiment at least partly arranged between said expander piston and said compressor piston. For example, the connecting rod(s) of the combustion cylinder(s) may be arranged between said expander piston and said compressor piston.

According to one embodiment, the first and second combustion cylinders operate in a four-stroke configuration, and each one of the compressor and expander cylinders operate in a two-stroke configuration.

According to one embodiment, the first and second combustion cylinders operate in common in a four-stroke configuration. According to one embodiment, the first and second combustion cylinders each operates in a two-stroke configuration. According to one embodiment, the first and second combustion cylinders each operate in a four-stroke configuration. Thus, the overall stroke of the ICE may be referred to as an eight-stroke engine (the respective two-stroke configuration of the expander and the compressor cylinders, and the four-stroke configuration of the combustion cylinders). According to one embodiment, the internal combustion engine is referred to as a dual compression expansion engine, DCEE.

According to at least a second aspect of the present disclosure, the object is achieved by a vehicle. The vehicle comprises an internal combustion engine system according to the first aspect of the disclosure.

Effects and features of this second aspect of the present disclosure are largely analogous to those described above in connection with the first aspect of the disclosure. Embodiments mentioned in relation to the first aspect of the present disclosure are largely compatible with the second aspect of the disclosure.

According to a third aspect of the present invention, there is provided a method for controlling a geometrical compression ratio of a reciprocating compressor of an internal combustion engine (ICE) system. The reciprocating compressor is configured to pressurize a fluid medium and having a compressor cylinder for accommodating a compressor piston. The compressor cylinder has a main cylinder volume and a secondary adjustable volume in fluid communication with the main cylinder volume so as to provide a variable geometrical compression ratio.

The method comprises the steps of: —adjusting the volume of the secondary adjustable volume to a first adjusted volume; and—pressurizing said fluid medium to a first geometrical compression ratio by a displacement of the compressor piston from a bottom dead centre (BDC) to top dead centre (TDC).

Effects and features of this third aspect of the present disclosure are largely analogous to those described above in connection with the first aspect of the disclosure. Embodiments mentioned in relation to the first aspect and the second aspect of the present disclosure are largely compatible with the third aspect of the disclosure.

According to at least one embodiment, the method further comprises the steps of: —determining an engine load of the ICE system; and—adjusting the volume of the secondary adjustable volume in response to the determined engine load.

The method according to the example embodiments can be executed in several different manners. According to one example embodiment, the steps of the method are performed by a control unit during use of the ICE system of the vehicle. According to one example embodiment, the steps of the method are performed in sequence. However, at least some of the steps of the method can be performed in parallel.

Further advantages and advantageous features of the disclosure are disclosed in the following description and in the dependent claims. It should also be readily appreciated that different features may be combined to create embodiments other than those described in the following, without departing from the scope of the present disclosure.

The terminology used herein is for the purpose of describing particular examples only and is not intended to be limiting of the disclosure. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

BRIEF DESCRIPTION OF THE DRAWINGS

The above, as well as additional objects, features and advantages of the present disclosure, will be better understood through the following illustrative and non-limiting detailed description of exemplary embodiments of the present disclosure, wherein.

DETAILED DESCRIPTION OF EXAMPLE EMBODIMENTS OF THE DISCLOSURE

Figure 1:
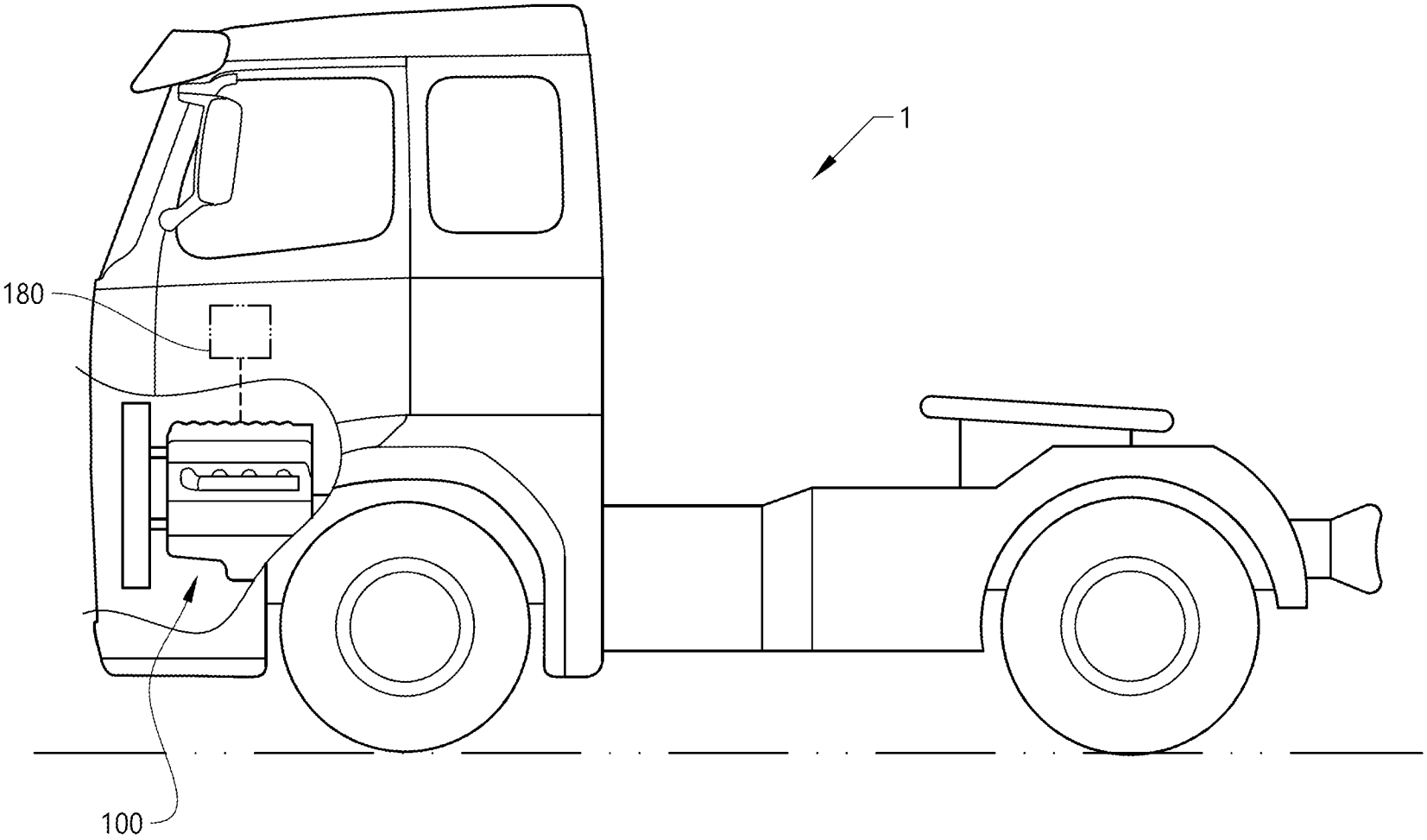
FIG. 1 is a side view of a vehicle comprising an internal combustion engine (ICE) system according to an example embodiment of the present disclosure.

The present disclosure will now be described more fully hereinafter with reference to the accompanying drawings, in which an exemplary embodiment of the disclosure is shown. The disclosure may, however, be embodied in many different forms and should not be construed as limited to the embodiment set forth herein; rather, the embodiment is provided for thoroughness and completeness. Like reference character refer to like elements throughout the description.

With particular reference to FIG. 1, there is provided a vehicle 1 with an internal combustion engine (ICE) system 100 according to the present disclosure. The vehicle 1 depicted in FIG. 1 is a truck for which the internal combustion engine system 100, which will be described in detail below, is particularly suitable for. The internal combustion engine system comprises at least a reciprocating compressor, as will be further described in relation to FIGS. 2 to 5. Moreover, the internal combustion engine system 100 includes an internal combustion engine (ICE). In this example, the ICE system is a hydrogen piston internal combustion engine system.

The combustion in such hydrogen ICE system is based on a combustion of air and hydrogen, as is commonly known in the art.

The ICE system further typically comprises a control unit 180, as illustrated in FIG. 1. As will be further described in relation to FIG. 5, the control unit 180 is configured to perform any one of a number of steps of a method for controlling the reciprocating compressor of the ICE system. The control unit 180 is here a part of a main electronic control unit for controlling the vehicle and various parts of the vehicle. In particular, the control unit 180 is arranged in communication with the reciprocating compressor and the other components of the ICE.

One example embodiment of a reciprocating compressor according to an example embodiment of the present disclosure will now be described in relation to FIG. 2 and FIGS. 3*a* to 3*f*, while further components of the ICE system will subsequently be described in relation to FIG. 4.

Figure 2:
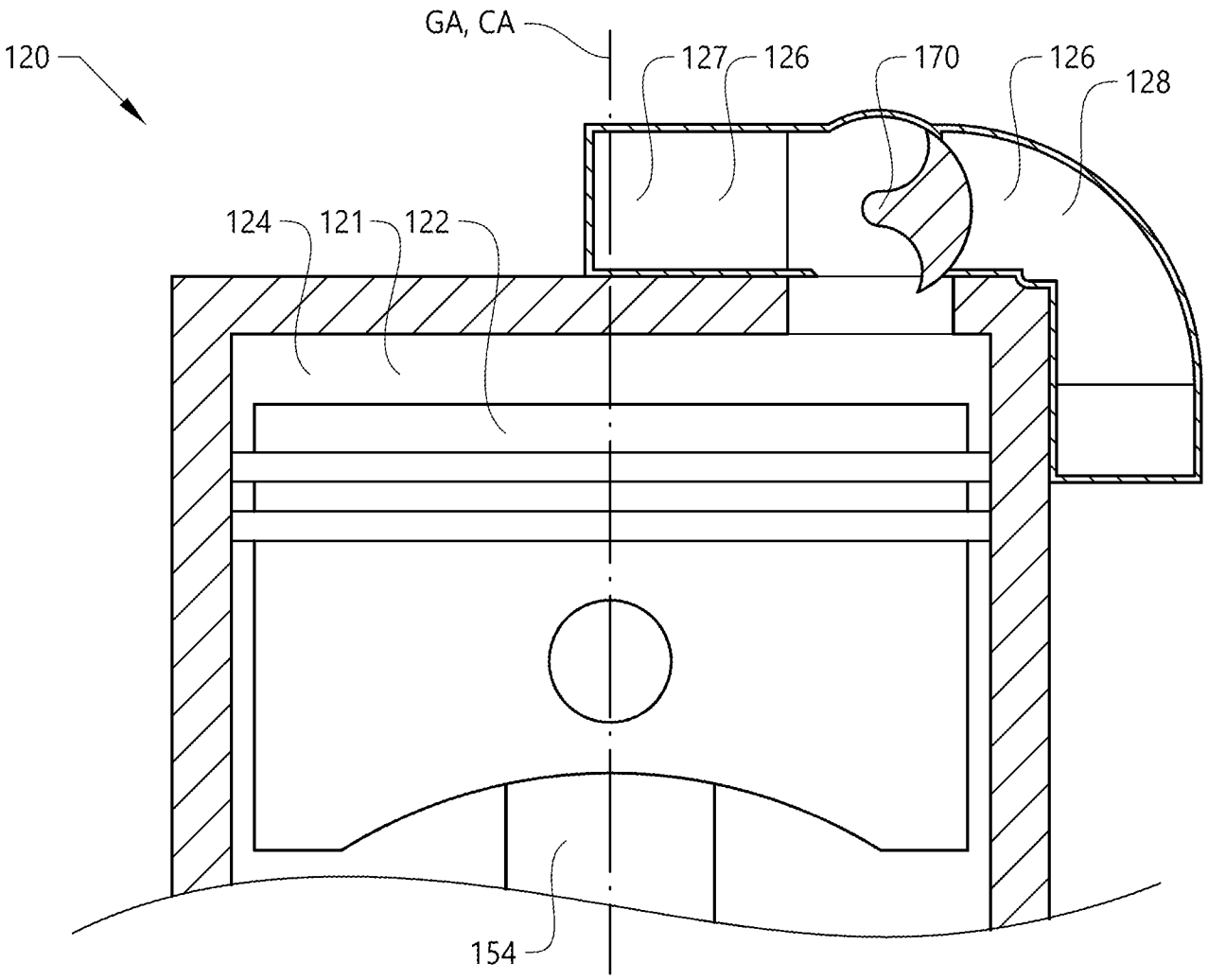
FIG. 2 is a side view of a reciprocating compressor of an ICE system according to an example embodiment of the present disclosure.

Turning to FIG. 2, there is depicted a reciprocating compressor 120 according to an example embodiment of the present disclosure for use in the ICE system 100 of FIG. 1. The reciprocating compressor 120 extends along a compression axis CA, typically corresponding to a longitudinal direction of the reciprocating compressor 120, as illustrated in FIG. 2. In this context, it should be noted that the term cylinder generally refers to a component having an interior space for accommodating a reciprocating piston, as is commonly known in the art. Further, it should be noted that the reciprocating compressor may sometimes be denoted as the compressor.

The reciprocating compressor 120 comprises a compressor cylinder 121 housing a compressor piston 122. The compressor piston is connected to a connecting rod 154. The compressor piston connecting rod 154 connects the compressor piston 122 to a crankshaft 140, as also illustrated in FIG. 4. As is commonly known in the art, the compressor cylinder 120 is configured to draw a volume of ambient air, compress the air, and transfer the compressed air to a suitable combustor of the ICE system. One example of a suitable combustor arrangement will be further described below in relation to FIG. 4, which depicts a combustor having first and second combustion cylinders 111, 114.

The reciprocating compressor is configured to compress air by a displacement of the compressor piston from a bottom dead center (BDC) to top dead center (TDC), as is commonly known in the art. In other words, the compressor cylinder 121 is design so as to accommodate the compressor piston 122. That is, the compressor cylinder 121 is configured to compress a volume of air by the compressor piston and subsequently transfer the compressed air to the combustor. To this end, the compressor cylinder comprises a main cylinder volume 124. The main cylinder volume is generally defined at the cylinder head of the compressor cylinder. Further, the main cylinder volume is generally defined by the interior surfaces of the cylinder head in combination with the compressor piston 122, as is illustrated in FIG. 2, which also corresponds to a conventional cylinder- and piston-arrangement. Accordingly, the main cylinder volume defines a first space for compressing the air.

Moreover, the reciprocating compressor 120 comprises a secondary adjustable volume 126, as illustrated in FIG. 2, and further in FIGS. 3*a* to 3*f*. The secondary adjustable volume 126 is arranged in fluid communication with the main cylinder volume 124. As will be evident from the below description of the reciprocating compressor 120, the secondary adjustable volume 126 provides for adjusting the total volume (interior space) of the reciprocating compressor 120. In this manner, it becomes possible to provide a variable geometrical compression ratio during operation of the reciprocating compressor 120, and the ICE system 100.

By way of example, as illustrated in FIG. 2, and more particularly in FIGS. 3*a* to 3*f*, the secondary adjustable volume 126 is defined by a number of sub-compartments 127 and 128. The sub-compartment 127 provides a first dead volume of a first size. Analogously, the sub-compartment 128 provides a second dead volume of a second size. Each one of the two sub-compartments 127 and 128, defining fixed dead volumes of different size, can be set in fluid communication with the main cylinder volume. Generally, the secondary adjustable volume 126 is set in fluid communication with the main cylinder volume 124 by means of a valve, such as the valve 170 in FIG. 2. In other words, each one of the two sub-compartments 127 and 128 can be set in fluid communication with the main cylinder volume 124 by means of the valve 170, which will be further described below.

As such, the secondary adjustable volume 126 is configured to provide for a geometrical compression ratio control of the compressor cylinder 121 by adjusting the volume of the secondary adjustable volume 126 into a number of defined dead volumes. The secondary adjacent volume here comprises a first sub-compartment 127 and a second sub-compartment 128. Moreover, the first sub-compartment 127 and the second sub-compartment 128 are here of different sizes, as illustrated in FIG. 2, and also further in FIGS. 3*a* to 3*f*. However, it should be noted that although the secondary adjustable volume here merely comprises the first sub-compartment 127 and the second sub-compartment 128 of different sizes, there is provided a secondary adjustable volume that can be adjusted into four different dead volumes. One example of such configuration of the secondary adjustable volume is now described in relation to FIGS. 3*c* to 3*f*.

Figure 3B:
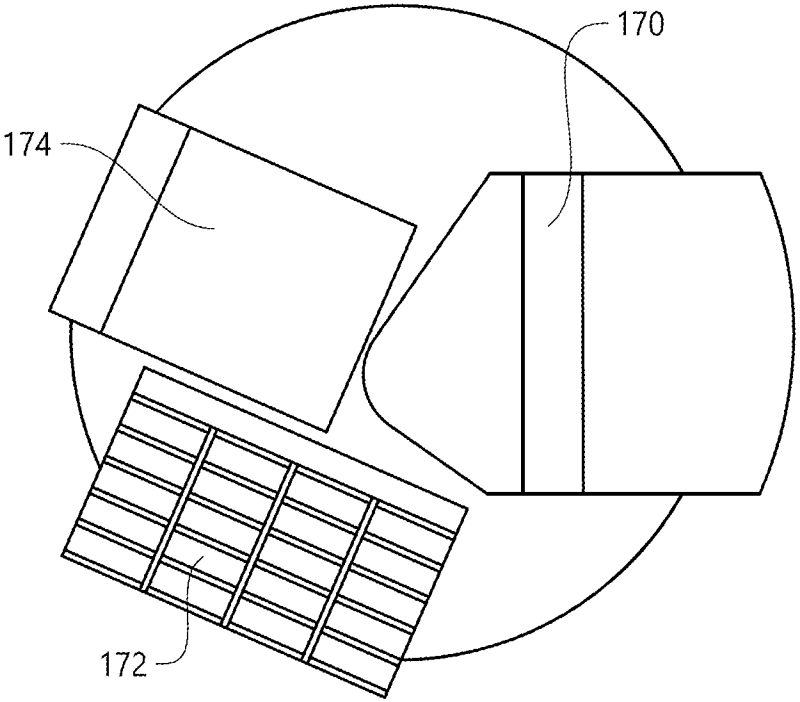
FIGS. 3*a* to 3*f* illustrate additional parts of the reciprocating compressor of FIG. 2 according to an example embodiment of the present disclosure.
Figure 3A:
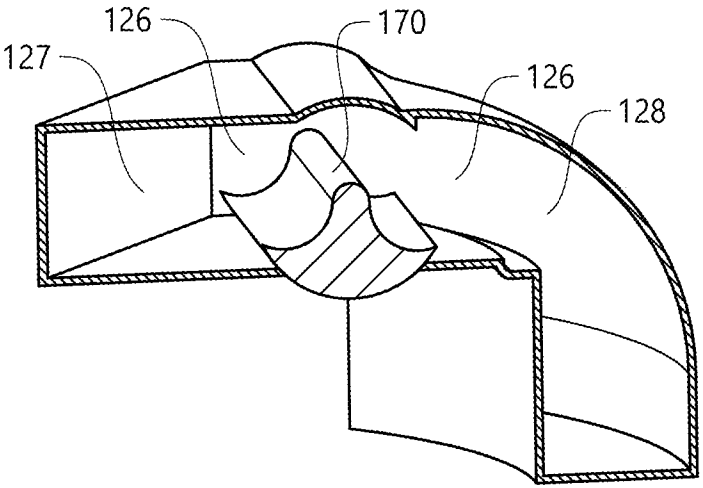
Figure 3D:
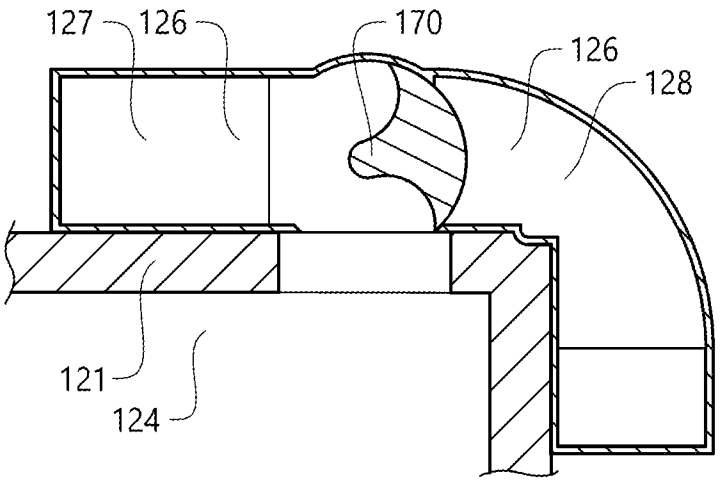
Figure 3C:
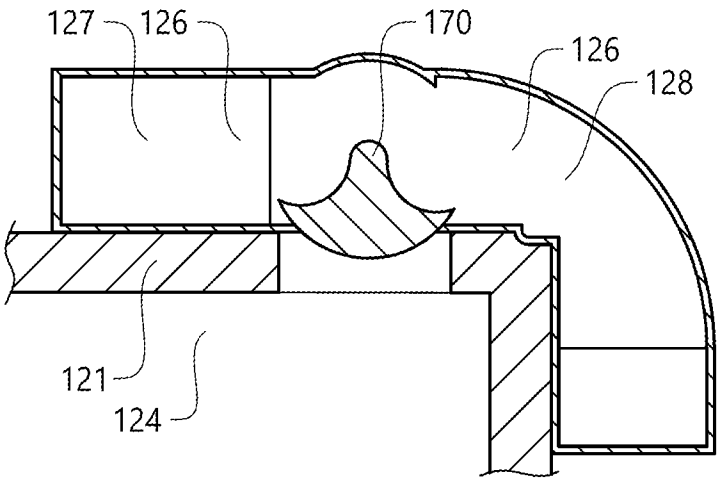

As mentioned above, and as shown in e.g. FIG. 3*c*, the reciprocating compressor 120 comprises the valve 170. In this example embodiment, the valve is a rotatable valve assembly arranged to rotate e.g. in a clockwise rotation in relation to its center axis. As illustrated in FIGS. 3*c* to 3*f*, the valve can open and close the entrance to the sub-compartments 127 and 128, respectively, by a rotation around its center axis. In the example illustrated in FIGS. 3*a* to 3*f*, the geometrical compression ratio control is provided by the two fixed dead volumes (defined by the compartments 127 and 128) of different size. The two sub-compartments 127 and 128 can be set in fluid communication with the main cylinder volume 124 of the compressor 120 by controlling the valve 170.

In the example embodiment as illustrated in FIGS. 3*a* to 3*f*, the size of the first sub-compartment 127 is smaller than the size of the second sub-compartment 128. Moreover, as mentioned above, the valve 170 can regulate the fluid medium passage between each one of the sub-compartments 127 and 128 and the main cylinder volume 124.

As illustrated in FIG. 3*c*, the valve 170 is set in a position to block the entrances to each one of the two sub-compartments 127 and 128. In this configuration of the secondary adjustable volume 170, no additional dead volume is provided. Therefore, the compression of air in the compressor 120 occurs solely in the main cylinder volume 124.

As illustrated in FIG. 3*d*, the valve 170 is set in a position to block the entrance to the larger one of the sub-compartments, i.e. the sub-compartment 128, while providing a fluid communication between the main cylinder volume 124 and the other one of the sub-compartments, i.e. the sub-compartment 127 (which is the smaller one of the sub-compartments). Hence, in this configuration of the secondary adjustable volume 170, a first dead volume of a first size is provided. To this end, the compression of air in the compressor 120 occurs in the main cylinder volume 124 and in the sub-compartment 127 of the secondary adjustable volume 126.

Figure 3F:
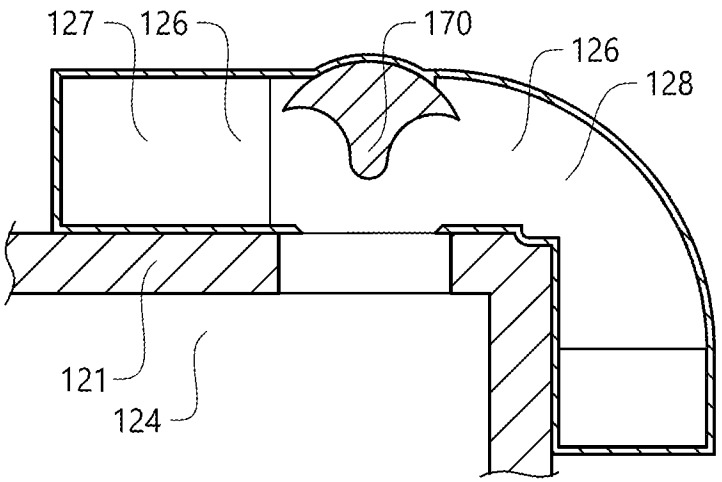
Figure 3E:
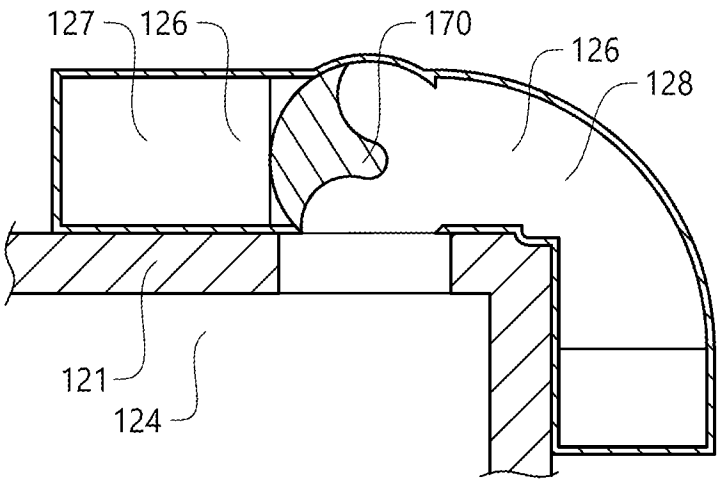

As illustrated in FIG. 3*e*, the valve 170 is set in a position to block the entrance to the smaller one of the sub-compartments, i.e. the sub-compartment 127, while providing a fluid communication between the main cylinder volume 124 and the other one of the sub-compartments, i.e. the sub-compartment 128 (which is the larger one of the sub-compartments). Hence, in this configuration of the secondary adjustable volume 170, a second dead volume of a second size is provided. To this end, the compression of air in the compressor 120 occurs in the main cylinder volume 124 and in the sub-compartment 128 of the secondary adjustable volume 126.

Finally, as illustrated in FIG. 3*f*, the valve 170 is set in a position to provide passages to both sub-compartments. In other words, the valve 170 is controlled to set the sub-compartment 127 and the sub-compartment 128 in fluid communication with the main cylinder volume 124. Hence, in this configuration of the secondary adjustable volume 170, a third dead volume of a third size is provided. To this end, the compression of air in the compressor 120 occurs in the main cylinder volume 124 together with volume defined by the sub-compartments 127 and 128 of the secondary adjustable volume 126.

Accordingly, it becomes possible to provide a plurality of different dead volume portions of different size. Since the volumes described above in relation to FIGS. 3*c* to 3*f* are different in size, it is possible to provide four different geometrical compression ratios.

It should also be noted that the two sub-compartments 127 and 128 may be of the same size. In such example, there is provided a secondary adjustable volume with two different dead volumes, one dead volume defined by one of the sub-compartments, and another dead volume defined by the combined size of the two sub-compartments.

It should be noted that a plurality of dead volume portions of different size can also be provided by other types of arrangement of sub-compartments in combination with other types of valves. In another example, the secondary adjustable volume can be provided by conventional on/off valves, slide valves, reed valves or any other types of valves suitable for being arranged in a compressor environment. By way of example (although not illustrated), the secondary adjustable volume may also be provided by a design where a slide valve is pressed against a port to a sub-compartment for sealing by means of the compression pressure in the compressor working chamber. In such example, a movement of the slide valve may occur at a similar pressure between the main cylinder volume and the secondary adjustable volume.

In another example embodiment (although not shown), each one of the two fixed dead volumes of different size is individually arranged in fluid communication with the main cylinder volume by a first and second valves, respectively.

Optionally, the reciprocating compressor 120 also comprises 172 and 174, as illustrated in FIGS. 3*a* to 3*f*. That is, the reciprocating compressor 120 generally comprises the inlet valve 172 for controlling inflow of air into the compressor. The inlet valve may e.g. be a conventional reed valve. Further, the reciprocating compressor 120 comprises an outlet valve 174 for exhaust of the compressed air.

Moreover, the valve 170 is generally controllable by means of the control unit 180, as mentioned above.

In order to control the compression of the air in relation to the operation of the ICE system, in particular the combustion reaction, and the operation of the vehicle, the geometrical compression ratio control as described above is generally based on an engine characteristic of the ICE system. Hence, although strictly not required, the volume of the secondary adjustable volume 126 is adjusted in response to the engine load of the ICE system.

The operation of the engine, i.e. the engine load, can be determined in several different ways. By way of example, the engine load of the ICE system is determined based on an actuation of a vehicle acceleration device, such as an acceleration pedal. The requested propulsion torque may e.g. be determined based on the position of the acceleration pedal, as manipulated by a driver. Typically, the ICE system comprises a sensor arranged to gather data indicating the engine load. The sensor may be arranged in communication with the control unit of the ICE system or the vehicle. The sensor (although not shown) may be arranged to detect a change in engine load and/or determine the engine load of the ICE for a given operational state. Subsequently, a value of the engine load, or an indication of a change in engine load, is transferred to the control unit 180 for further processing. To this end, the control unit 180 is configured to determine the engine load of the ICE system based on the gathered data and further to adjust the volume of the secondary adjustable volume in response to the determined engine load.

In another example embodiment, the ICE system comprises a sensor device (although not shown) for detecting the position of the compressor piston 122 in the compressor cylinder 121. Moreover, the volume of the secondary adjustable volume 126 is adjusted in response to the detected position of the compressor piston 122 in the compressor cylinder 121 so as to adjust the volume of the secondary adjustable volume 126 based on a working point of the compressor 120.

Generally, the valve 170 is regulated (adjusted) by a applying a force on the valve so as to rotate the valve into an open position. Likely, the valve 170 is rotated from one position to another position when the pressure in the cylinder is reduced to certain level, as may be set by the control unit or the function of the valve.

Accordingly, the engine load as well as a change in engine load can be monitored and determined in several different ways.

Optionally, the ICE system is operable such that the fluid communication between the main cylinder volume 121 and the secondary adjustable volume 126 is always open during a compression stroke. If the secondary adjustable volume is regulated in response to the engine load, the ICE system is generally operable such that the fluid communication between the main cylinder and the secondary adjustable volume is always open during a compression stroke and until there is a change in engine load. However, it should be readily appreciated that in other situations, the fluid communication between the main cylinder volume 121 and the secondary adjustable volume 126 may be controlled to be closed during the compression stroke.

Figure 4:
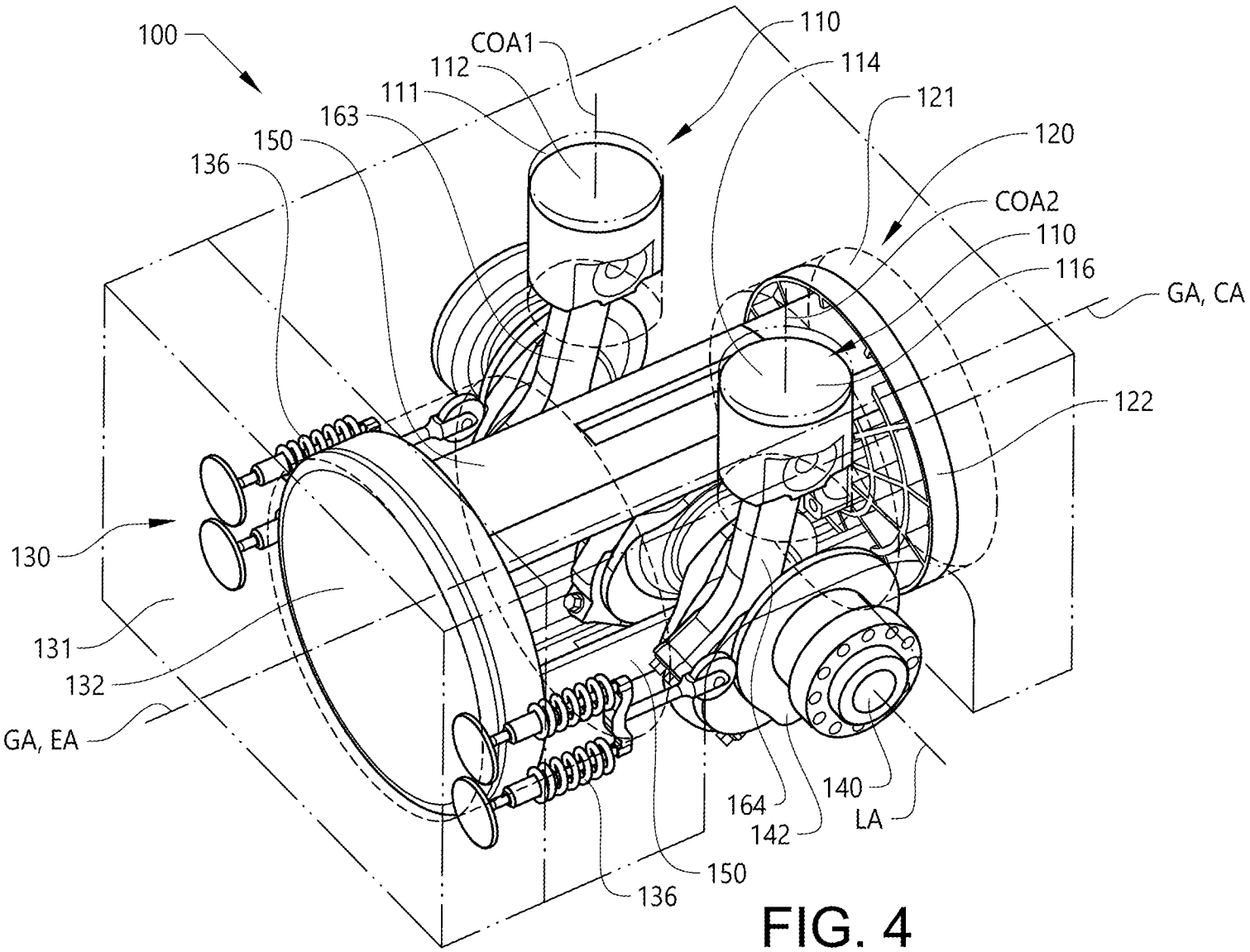
FIG. 4 is a perspective view of the ICE system according to an example embodiment of the present disclosure.

Turning now to FIG. 4, which is a perspective view of some additional components of the example embodiment of the ICE system 100 in FIG. 1. Firstly, it should be noted a that full illustration of the cylinders housing the respective pistons have been omitted from FIG. 4 for simplicity of understanding the disclosure and the piston configurations.

Hence, while it should be noted that the ICE system may include several cylinders, the internal combustion engine system 100 here comprises at least a piston combustor assembly 110 having at least one combustion cylinder 111 housing a first combustion piston 112, and a second combustion cylinder 114 housing a second combustion piston 116. As mentioned above, the internal combustion engine system 100 further comprises the compressor 120 having the compressor cylinder 121 housing the compressor piston 122. Also, as depicted in FIG. 4, the ICE system 100 comprises an expander 130 in the form of a two-stroke machine. The expander 130 comprises an expander cylinder 131 housing an expander piston 132.

Turning again to the combustor assembly 110, it should be understood that the first and second combustion pistons 112, 116 are individually arranged inside the first and second combustion cylinders 111, 114, respectively, and are adapted for reciprocating motion therein. Correspondingly, the compressor piston 122 and the expander piston 132 are arranged inside the compressor cylinder 121 and the expander cylinder 131, respectively, and are adapted for reciprocating motion therein.

Moreover, as shown in e.g. FIG. 4, the ICE system 100 comprises a crankshaft 140. The crankshaft is rotatable around an axis of rotation, generally corresponding to a longitudinal axis LA of the crankshaft. The rotatable crankshaft is generally arranged in the ICE system so as to rotate by means of the power pistons and also effect a linear movement of the other piston(s) of the ICE system, as further described in more detail below.

As mentioned above, the ICE system 100 comprises the compressor piston connecting rod 154 connecting the compressor piston 122 to the crankshaft 140, as illustrated in FIG. 4. Further, in FIG. 4, the expander piston 132 is connected to the compressor piston 122 by a connecting element assembly 150. Alternatively, although not shown, the ICE system comprises an expander piston connecting rod connecting the expander piston 132 to the crankshaft 140. In this example, the expander piston 132 may still also be connected to the compressor piston 122 by a similar connecting element assembly.

Correspondingly, as illustrated in FIG. 4, a first combustion piston connecting rod 163 connects the first combustion piston 112 to the crankshaft 140, and a second combustion piston connecting rod 164 connects the second combustion piston 114 to the crankshaft 140. Thus, the above-mentioned reciprocating motions of the pistons can be transferred into a rotational motion of the crankshaft 140.

By way of example, as illustrated in e.g. FIG. 4, the expander piston 132 is connected to the compressor piston 122 by a connecting element assembly 150 in the form of two connecting arms arranged in a respective periphery portion of the expander and compressor cylinders 132, 122. Each one of the connecting arms typically extends from the expander piston 132 to the compressor piston 122. Even though two connecting arms are shown in FIG. 4, it should be understood that other number of connecting arms, or only one connecting arm, may be used within the concept of the disclosure. Moreover, the connecting element assembly 150 may be arranged with no connecting arms, but instead as e.g. a connecting envelope extending from the expander piston 132 to the compressor piston 122, such that the expander piston 132 and the compressor piston 122 move in unison. The connecting element assembly 150 should be rigidly connected the expander piston 132 to the compressor piston 122, such that the expander piston 132 and the compressor piston 122 move in unison. By way of example, the connecting element assembly 150 rigidly connects the expander piston 132 with the compressor piston 122 such that when the compressor piston 122 moves in a downstroke (i.e. in order to compress the air in the compressor cylinder 121), the expander piston 132 moves in a stroke following the motion of the compressor piston 122. Correspondingly, as the expander piston 132 moves in an upstroke, the compressor piston 122 moves in a stroke following the motion of the expander piston 132.

As shown in FIG. 4, the compressor cylinder 121 and the expander cylinder 132 are positioned on opposite sides of, and in close proximity to, the crankshaft 140. Stated differently, a substantial portion of the crankshaft 140 is generally arranged in between the expander piston 132 and the compressor piston 122, such that the substantial portion of crankshaft is arranged between respective crankshaft facing surfaces of the compressor piston and the expander piston, as illustrated in e.g. FIG. 4. In other words, the compressor piston 122, the expander piston 132 and the substantial portion of the crankshaft 140 are arranged along a geometrical axis GA, and the substantial portion of the crankshaft 140 is arranged along the geometrical axis GA in between the compressor piston 122 and the expander piston 132. In this manner, there is provided a so-called compressor-expander arrangement enclosing a substantial portion of the crankshaft 140. The internal position of the components in the ICE system 100 may be described in a different manner.

In at least a third way of describing the internal position of the components in the ICE system 100, the expander piston 132 has a circular, or round, cross section extending in a first geometrical plane, and the compressor piston 122 has a circular, or round, cross section extending in a second geometrical plane, the first and second geometrical planes being positioned in a parallel configuration on opposite sides of the longitudinal axis LA of the crankshaft 140.

As seen in FIG. 4, the expander piston 132 is configured for a reciprocating motion inside of the expander cylinder 131 along the expander axis EA. Correspondingly, the compressor piston 122 is configured for a reciprocating motion inside of the compressor cylinder 121 along a compressor axis CA. Correspondingly, the first combustion piston 112 is configured for a reciprocating motion inside of the first combustion cylinder 111 along a combustion axis CoA1, and the second combustion piston 116 is configured for a reciprocating motion inside of the second combustion cylinder 114 along a combustion axis CoA2. As seen in e.g. FIG. 4, the expander cylinder 130 and the compressor cylinder 120 are co-axially arranged, i.e. the expander axis EA and the compressor axis CA are aligned.

Turning back to FIG. 4, it is shown that the first combustion cylinder 111 and the second combustion cylinder 114 may be described as protruding laterally from the crankshaft 140 compared to the expander cylinder 130. Thus, the expander cylinder 130, and the first and second combustion cylinders 111, 114 are arranged inside the ICE system 100 in such way that the expander axis EA is angled in relation to each one of the combustion axis CoA1, CoA2 by between 40 degrees and 90 degrees, preferably between 50 degrees and 75 degrees, and more preferably between 55 degrees and 65 degrees, such as e.g. about 60 degrees.

The function of the ICE system 100 will now be further elucidated with reference FIG. 4. The compressor cylinder 120 is configured to draw a volume of ambient air, compress the air, and transfer the compressed air to the first and second combustion cylinders 111, 114. The first and second combustion cylinders 111, 114 are configured to be energized by forces of combustion, e.g. by ignition of the fuel by means of a spark plug (e.g. as for a petrol or gasoline driven engine) or heat originating from compression (e.g. as for a diesel driven engine). The expander cylinder 130 is configured to receive exhaust gases from the first and second combustion pistons 112, 116. Transportation of air, fuel and gases are carried out by means of corresponding inlet valves 136, transfer ports, and outlet valves 136 known by the skilled person in the art, and which fluidly interconnects the compressor cylinder 121, the first and second combustion cylinders 111, 114 and the expander cylinder 131.

In one example, the crankshaft is driven by at least one of the combustion pistons by means of a corresponding combustion piston connecting rod, and is driven by the expander piston by means of a corresponding expander piston connecting rod, wherein the compressor piston is driven by the crankshaft by means of the expander piston.

However, a slightly opposite arrangement may also be possible, which is also illustrated in the ICE system in FIG. 4. That is, the expander piston 132 is not directly connected to the crankshaft 140, via its own connecting rod, but is instead connected to the crankshaft 140 via the connecting element assembly 150, the compressor piston 122 and the compressor piston connecting rod 154. Hereby, the rotational motion of the crankshaft 140 is transferred into a reciprocating motion of the expander piston 132 via the compressor piston connecting rod 154. Thus, the crankshaft 140 is driven by the first and second combustion pistons 112, 116 by means of the respective combustion piston connecting rods and is driven by the compressor piston by means of the compressor piston connecting rod 154, but the crankshaft 140 drives the expander piston 132 by means of the compressor piston 122 and the compressor piston connecting rod 154.

Figure 5:
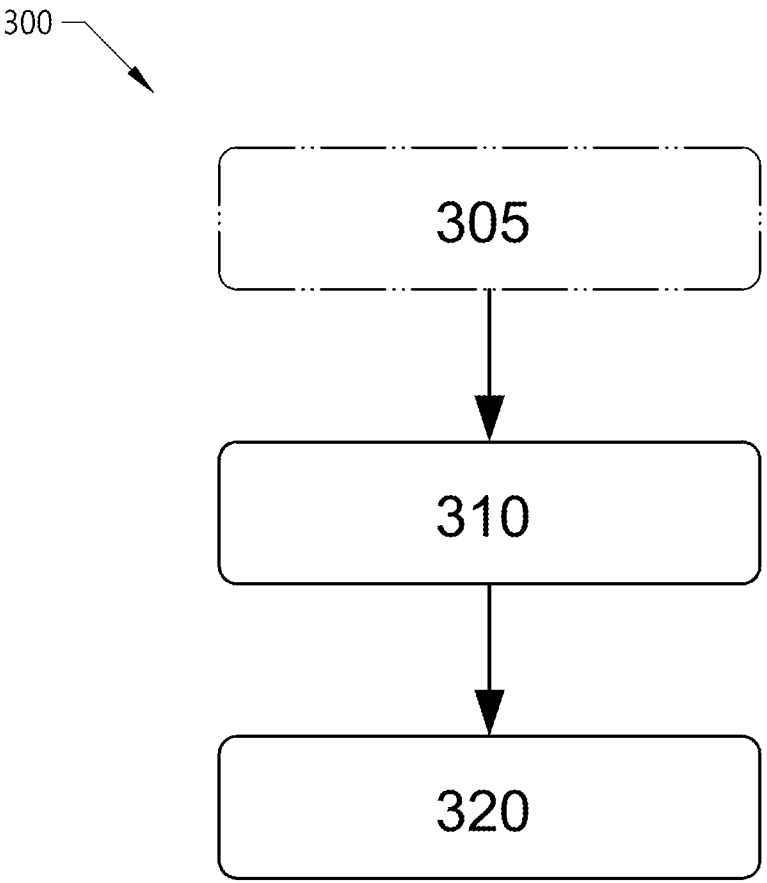
FIG. 5 is a flow-chart of a method according to an example embodiment of the present disclosure, in which the method comprises a number of steps for controlling a geometrical compression ratio of a reciprocating compressor of an ICE system in FIG. 1.

In FIG. 5, there is depicted a method 300 for controlling a geometrical compression ratio of the reciprocating compressor 120, as described above in relation to FIG. 1 and further in FIGS. 3*a* to 3*f* and FIG. 4. The method is generally performed by the control unit 180 during operation of the ICE system 100. Optionally, as a first step, the method comprises the step of determining 105 an engine load of the ICE system 100. The engine load may generally be determined as previously described herein. Subsequently, in step 310, the volume of the secondary adjustable volume 126 is adjusted to a first adjusted volume. That is, the volume of the secondary adjustable volume 126 is adjusted in response to the determined engine load. Thereafter, in step 320, the reciprocating compressor pressurizes the air to a first geometrical compression ratio. Subsequently, the compressed air is transferred to the combustion cylinder(s), as mentioned above in relation to FIG. 4.

It is to be understood that the present disclosure is not limited to the embodiments described above and illustrated in the drawings; rather, the skilled person will recognize that many changes and modifications may be made within the scope of the appended claims.

The invention claimed is:

1. An internal combustion engine system comprising a reciprocating compressor for pressurizing a fluid medium and having a compressor cylinder for accommodating a compressor piston, said compressor cylinder having a main cylinder volume and a secondary adjustable volume in fluid communication with the main cylinder volume so as to provide a variable geometrical compression ratio, wherein the secondary adjustable volume comprises at least a plurality of volume compartment portions which are capable of separation by at least one valve, and wherein each of the plurality of volume compartment portions are individually arranged in fluid communication with the main cylinder volume via the at least one valve.

2. The internal combustion engine system according to claim 1, wherein the secondary adjustable volume is configured to provide for a geometrical compression ratio control of the compressor cylinder by adjusting the volume of the secondary adjustable volume into a number of defined volumes.

3. The internal combustion engine system according to claim 1, wherein the plurality of volume compartment portions are different sizes.

4. The internal combustion engine system according to claim 1, wherein the plurality of volume compartment portions are of fixed size.

5. The internal combustion engine system according claim 3, wherein a total dead volume is provided by at least two volume compartment portions of different size, each one of the two volume compartment portions of different size being individually arranged in fluid communication with the main cylinder volume by the at least one valve.

6. The internal combustion engine system according to claim 5, wherein the at least one valve is a rotatable valve assembly arranged to open and close an entrance to the at least two volume compartment portions of different size, respectively, by a rotation of the rotatable valve around its center axis.

7. The internal combustion engine system according to claim 1, wherein the volume of the secondary adjustable volume is adjusted in response to an engine load of the ICE system.

8. The internal combustion engine system according to claim 1, wherein the volume of the secondary adjustable volume is adjusted in response to a position of the compressor piston in the compressor cylinder so as to adjust the volume of the secondary adjustable volume based on the engine load.

9. The internal combustion engine system according to claim 1, wherein ICE system is operable such that the fluid communication between the main cylinder and the secondary adjustable volume is always open during a compression stroke.

10. The internal combustion engine system according to claim 1, wherein the ICE system comprises a control unit for controlling the secondary adjustable volume.

11. The internal combustion engine system according to claim 1, wherein the reciprocating compressor is operable by a crankshaft of an internal combustion engine.

12. The internal combustion engine system according to claim 1, further comprising at least one combustion cylinder housing a combustion piston, said combustion cylinder being configured to be energized by forces of combustion; said compressor cylinder being configured to compress a volume of; an expander cylinder housing an expander piston, said expander cylinder being in fluid communication with the at least one combustion piston.

13. A vehicle comprising an internal combustion engine system according to claim 1.

14. A method for controlling a geometrical compression ratio of a reciprocating compressor of an internal combustion engine system, said reciprocating compressor is configured to pressurize a fluid medium and having a compressor cylinder for accommodating a compressor piston, said compressor cylinder having a main cylinder volume and a secondary adjustable volume in fluid communication with the main cylinder volume so as to provide a variable geometrical compression ratio wherein the secondary adjustable volume comprises at least a plurality of volume compartment portions which are capable of separation by at least one valve, and wherein each of the plurality of volume compartment portions are individually arranged in fluid communication with the main cylinder volume via the at least one valve, wherein the method comprising the steps of:

adjusting the volume of the secondary adjustable volume to a first adjusted volume; and pressurizing said fluid medium to a first geometrical compression ratio by a displacement of the compressor piston from a bottom dead center to top dead center.

15. The method according to claim 14, further comprising the steps of:

determining an engine load of the ICE system; and adjusting the volume of the secondary adjustable volume in response to the determined engine load.

* * * * *